US006970153B2

(12) United States Patent
Park

(10) Patent No.: US 6,970,153 B2
(45) Date of Patent: Nov. 29, 2005

(54) SOURCE DRIVER CIRCUIT OF THIN FILM TRANSISTOR LIQUID CRYSTAL DISPLAY FOR REDUCING SLEW RATE, AND METHOD THEREOF

(75) Inventor: Sang-ho Park, Suwon (KR)

(73) Assignee: Samsung Electronics, Co., Ltd., (KR)

( * ) Notice: Subject to any disclaimer, the term of this patent is extended or adjusted under 35 U.S.C. 154(b) by 364 days.

(21) Appl. No.: 10/320,217

(22) Filed: Dec. 16, 2002

(65) Prior Publication Data

US 2003/0160752 A1 Aug. 28, 2003

(30) Foreign Application Priority Data

Feb. 23, 2002 (KR) ..... 2002-9732

(51) Int. Cl.[7] ..... G09G 3/36
(52) U.S. Cl. ..... 345/102; 345/98; 345/100
(58) Field of Search ..... 345/98, 100, 102, 345/96

(56) References Cited

U.S. PATENT DOCUMENTS

| | | | | |
|---|---|---|---|---|
| 5,973,660 | A | 10/1999 | Hashimoto | 345/98 |
| 6,335,721 | B1 * | 1/2002 | Jeong | 345/100 |
| 2001/0035862 | A1 * | 11/2001 | Nakamura et al. | |
| 2002/0027545 | A1 * | 3/2002 | Park et al. | |

FOREIGN PATENT DOCUMENTS

| | | | |
|---|---|---|---|
| JP | 10062744 | 3/1998 | G02F 1/133 |
| JP | 2001343944 | 12/2001 | G09G 3/36 |

* cited by examiner

*Primary Examiner*—Richard Hjerpe
*Assistant Examiner*—Tammy Pham
(74) *Attorney, Agent, or Firm*—Mills and Onello, LLP

(57) ABSTRACT

A source driver circuit and method for use in a thin film transistor liquid crystal display that can reduce the slew rate of color data includes a data latching unit for receiving and storing color data in response to a main clock signal, and outputting the stored color data in response to a predetermined first control signal; a switching buffering unit for receiving the color data output from the data latching unit, and applying the color data to a panel in response to a predetermined second control signal; and an output controller for generating the first and second control signals in response to the main clock signal, a polarity inversion signal that controls the polarity of voltage of the color data output to the panel, and the first clock signal. According to the source driver circuit and method, the slew rate of the color data, which is to be applied to a panel, can be reduced using the existing signals, without additionally making signals at the outside of a semiconductor chip. Also, in this source driver circuit, a switching current caused by the switching of a shift register and an output buffer at once is reduced, and the size of a driving transistor that is used to reduce the slew rate of color data can be reduced, thereby reducing power consumption and the resulting size of the chip.

24 Claims, 8 Drawing Sheets

SOURCE DRIVER CIRCUIT OF THIN FILM TRANSISTOR LIQUID CRYSTAL DISPLAY FOR REDUCING SLEW RATE, AND METHOD THEREOF

CROSS-REFERENCE TO RELATED APPLICATIONS

This application is based upon and claims priority to Korean Patent Application No. 2002-9732, filed 23 Feb. 2002, the contents of which are incorporated herein by reference.

BACKGROUND OF THE INVENTION

1. Field of the Invention

The present invention relates to a thin film transistor liquid crystal display (LCD), and more particularly, to a source driver circuit for use in a thin film transistor LCD, which is capable of reducing the slew rate of color data.

2. Description of the Related Art

In general, a liquid crystal display (LCD) includes a gate driver that actuates gate lines of a panel, and a source driver that actuates source lines of the panel. The LCD displays an image, or screen, on the panel by applying high voltage to the panel with the gate driver to cause an electric current to flow through the panel, and then applying a gradient voltage, which is a signal output from a source driver, and indicates the color of an image, to each source line with the source driver.

More specifically, the source driver receives color data of 6 bits per pixel, which is to be displayed on the panel, from a processor. Then, color data corresponding to a pixel of a gate line of the panel is input to and latched in the source driver. After the color data for each gate line of the panel is latched, the latched color data is multiplexed into color data for each pixel and then voltages for displaying color are simultaneously applied to the lines of the panel. At this time, the gate driver applies high voltage to only one gate line and turns on a transistor so as to store color data, which has been applied to the source line, in a corresponding gate line. As a result, each of the voltages for displaying colors are stored, thereby displaying a color for each pixel.

FIG. 1 is a block diagram of a source driver circuit 100 of a conventional thin film transistor LCD, and FIG. 2 is a timing diagram of the operation of the source driver circuit 100 of FIG. 1.

Referring to FIG. 1, the conventional source driver circuit 100 includes a shift register 110, a first data latch 120, a second data latch 130, a decoder 140 and an output buffer 150. The shift register 110 receives a main clock signal MCLK and applies it to the first data latch 120. In response to the main clock signal MCLK, color data DATA is input to, and latched by, the first data latch 120. The second latch 130 receives the color data DATA from the first data latch 120, and outputs it in response to a first clock signal CLK1. The decoder 140 receives the color data DATA output from the second latch 130 and causes the color data DATA to maintain a normal voltage level in response to a voltage control signal VGMA. The output buffer 150 receives the color data DATA having a normal voltage level, inverts the polarity of color data YDATA in response to a polarity inversion signal POL, which indicates whether the voltage level of the color DATA is higher or lower than a predetermined reference voltage, and outputs the color data YDATA to a panel 160.

Here, the slew rate of the color data YDATA, which is output from the buffer 150 in the source driver circuit 100, is one of the primary factors that determine the quality of an image. In particular, since a panel of an ultra extended graphics array (UXGA) grade has a horizontal synchronization period of 13–15 $\mu$s at maximum, it is difficult to produce an image of good quality in the event that the slew rate of the color data YDATA is more than 3 $\mu$s.

The slew rate of the color data YDATA output from the output buffer 150 is limited by the large load of the panel 160. The color data YDATA output from the output buffer 150 cannot be in the square wave form because of the resistance or capacitance of the panel external to the source driver circuit 100.

Referring to FIG. 2, the color data YDATA output from the output buffer 150 is output in response to a first clock signal CLK1. Here, it is noted that the polarity of the color data YDATA changes with respect to a reference voltage VCOM whenever the phase of a polarity inversion signal POL changes.

The color data YDATA is output in response to the first clock signal CLK1. The first clock signal CLK1 is a signal applied to the second data latch 130. Thus, the slew rate of the color data YDATA contains information with respect to the time required for the second data latch 130 to move data to the output buffer 150. FIG. 2 reveals that if the color data YDATA has a long slew rate, the output curve of the color data YDATA changes to a certain degree. Accordingly, an increase in the slew rate results in an increase in power consumption in the source driver circuit. In addition, the characteristics of the panel 160 of FIG. 1, having high load and definition, can become unstable.

SUMMARY OF THE INVENTION

To address the above-described limitations, it is a first object of the present invention to provide a source driver circuit capable of reducing the slew rate of color data by applying the color data to an output buffer before receiving a signal that provides a command for applying the color data to a panel.

It is a second object of the present invention to provide a method of adjusting the slew rate of color data by applying the color data to an output buffer before receiving a signal that provides a command for applying the color data to a panel.

Accordingly, to achieve an aspect of the first object, there is provided a source driver circuit for use in a thin film transistor liquid crystal display (LCD), the source driver circuit including a data latching unit for receiving and storing color data in response to a main clock signal, and outputting the stored color data in response to a first control signal; a switching buffering unit for receiving the color data output from the data latching unit, and applying the color data to a panel in response to a second control signal; and an output controller for generating the first and second control signals in response to the main clock signal, a polarity inversion signal that controls the polarity of voltage of the color data output to the panel, and the first clock signal.

Preferably, the first control signal is activated in response to a rising edge or falling edge of the polarity inversion signal whenever the phase of the polarity inversion signal is inverted, and the first clock signal is output as the first control signal when the phase of the polarity inversion signal does not change.

Preferably, the second control signal is deactivated in response to a rising edge or falling edge of the polarity inversion signal whenever the phase of the polarity inversion signal is inverted, activated in response to a rising edge of the first clock signal, and maintained at the same level when the phase of the polarity inversion signal does not change.

Preferably, the output controller includes a delayer for receiving the polarity inversion signal in response to the main clock signal, and delaying and outputting the polarity inversion signal for a predetermined time; a first control signal generator for receiving the polarity inversion signal in response to the first clock signal, generating the first control signal that is activated whenever the phase of the polarity inversion signal is inverted, and outputting the first clock signal as the first control signal when the phase of the polarity inversion signal does not change; and a second control signal generator for receiving the polarity inversion signal, a signal output from the delayer, and a delayed first clock signal, and generating the second control signal that is deactivated in response to a rising edge or falling edge of the polarity inversion signal, activated in response to a rising edge of the first clock signal, and maintained at the same level when the phase of the polarity inversion signal does not change.

Preferably, the second control signal generator further includes a delay clock unit that receives the first clock signal in response to the main clock signal, delays the first clock signal for a predetermined time, and outputs it as a delayed first clock signal.

Preferably, the delayer includes a plurality of flip flops.

Preferably, the first control signal generator includes first and second flip flops for receiving the polarity inversion signal in response to the first clock signal, and delaying and outputting the polarity inversion signal; a second X-OR means for receiving outputs of the first and second flip flops and performing an X-OR operation on them; a second inverter for inverting and outputting an output of the second X-OR means; an AND means for performing an AND operation on an output of the second inverter and the first clock signal; a third X-OR means for performing an X-OR operation on a signal that is an inverted signal of the inverted output of the first flip flop of the delayer, and a signal output from the third flip flop; and an OR means for performing an OR operation on the outputs of the third X-OR means and the AND means, and outputting the result as the first control signal.

Preferably, the second control signal generator includes a first X-OR means for receiving the polarity inversion signal and a signal output from the delayer, and performing an X-OR operation on them; an SR latch for receiving and outputting an output of the first X-OR means and the delayed first clock signal; and a first inverter for inverting an output of the SR latch and outputting it as the second control signal.

To achieve another aspect of the first object, there is provided a source driver circuit for use in a thin film transistor LCD, the source driver circuit including a data latching unit for receiving and storing color data in response to a main clock signal, and outputting the stored color data in response to a first control signal; and a switch buffering unit for receiving the color data output from the data latching unit, and applying the color data to a panel in response to a second control signal.

Preferably, the first control signal is generated in response to the main clock signal, a polarity inversion signal that controls the polarity of voltage of the color data, and a first clock signal, and activated for a predetermined time in response to a rising edge or falling edge whenever the phase of the polarity inversion signal is inverted, and the first clock signal is output as the first control signal when the phase of the polarity inversion signal does not change. Preferably, the second control signal is generated in response to the main clock signal, the polarity inversion signal that controls the polarity of the voltage of the color data input to the panel, and the first clock signal; deactivated in response to a rising edge or falling edge of the polarity inversion signal whenever the phase of the polarity inversion signal is inverted; activated in response to a rising edge of the first clock signal; and maintained at the same level when the phase of the polarity inversion signal does not change.

To achieve still another aspect of the first object, there is provided a source driver circuit for use in a thin film transistor LCD, the source driver circuit including a first data latch for receiving and storing color data in response to a main clock signal; a second data latch for receiving and storing the color data output from the first data latch, and outputting the stored color data in response to a first control signal; a decoder for decoding each color data output from the second data latch to indicate constant voltage in response to a voltage control signal; an output buffer for receiving, buffering and outputting the color data output from the decoder; an output switch for applying or confining the color data, which is output from the output buffer, to or from a panel in response to a second control signal; and an output controller for generating the first and second control signals in response to the main clock signal, a polarity inversion signal that controls the polarity of the voltage of the color data, and a first clock signal.

Preferably, the second control signal generator further includes a delay clock unit for receiving the first clock signal in response to the main clock signal, delaying the first clock signal, and outputting it as the delayed first clock signal.

Preferably, the delayer includes a plurality of flip flops.

Preferably, the first control signal generator includes first and second flip flops for receiving, delaying and outputting the polarity inversion signal in response to the first clock signal; a second X-OR means for receiving signals output from the first and second flip flops, and performing an X-OR operation on these signals; a second inverter for inverting and outputting an output of the second X-OR means; an AND means for performing an AND operation on an output of the second inverter and the first clock signal; a third X-OR means for performing an X-OR operation on a signal that is an inverted signal of the inverted output of the first flip flop among the flip flops of the delayer, and a signal output from the third flip flop; and an OR means for performing an OR operation on outputs of the third X-OR means and the AND means, and outputting the result as the first control signal.

Preferably, the second control signal generator includes a first X-OR means for receiving the polarity inversion signal and a signal output from the delayer, and performing an X-OR operation on these signals; an SR latch for receiving an output from the first X-OR means and the delayed first clock signal and outputting the output from the first X-OR means; and a first inverter for inverting an output of the SR latch and outputting the result as the second control signal.

To achieve the second object, there is provided a method of adjusting the slew rate of color data applied to a panel from a source driver circuit for use in a thin film transistor LCD, the method including (a) receiving and storing color data in response to a main clock signal, and outputting the stored color data in response to a first control signal; and (b) receiving the output color data, and applying the color data to a panel in response to a second control signal.

Preferably, step (a) includes (a1) receiving and storing the color data in response to the main clock signal; (a2) generating the first control signal in response to the main clock signal, a polarity inversion signal that controls the polarity of the voltage of the color data, and a first clock signal; and (a3) outputting the color data in response to the first control signal. Preferably, step (a2) includes (a21) receiving the polarity inversion signal in response to the first clock signal, and performing an X-OR operation on two signals obtained by delaying the polarity inversion signal for different times; (a22) inverting and outputting the result of step (a21); (a23) performing an AND operation on the result of step (a22) and the first clock signal; (a24) receiving the polarity inversion signal in response to the main clock signal, and performing an X-OR operation on two signals obtained by delaying the polarity inversion signal for different times; and (a25) generating the first control signal by performing an OR operation on the results of steps (a23) and (a24).

Preferably, step (b) includes (b1) receiving the output color data, and decoding each of the color data to indicate constant voltage; (b2) receiving, buffering and outputting the decoded color data; (b3) generating the second control signal in response to the main clock signal, the polarity inversion signal that controls the polarity of voltage of the color data, and the first clock signal; and (b4) applying the color data to the panel in response to the second control signal.

As described above, in a source driver circuit and a method of reducing the slew rate of color data according to the present invention, the slew rate of the color data, which is to be applied to a panel, can be reduced using the existing signals, without additionally making signals at the outside of a semiconductor chip. Also, in this source driver circuit, a switching current caused by the switching of a shift register and an output buffer at once is reduced, and the size of a driving transistor that is used to reduce the slew rate of color data can be reduced, thereby reducing power consumption and the size of a chip.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF PREFERRED EMBODIMENTS

Figure 1:
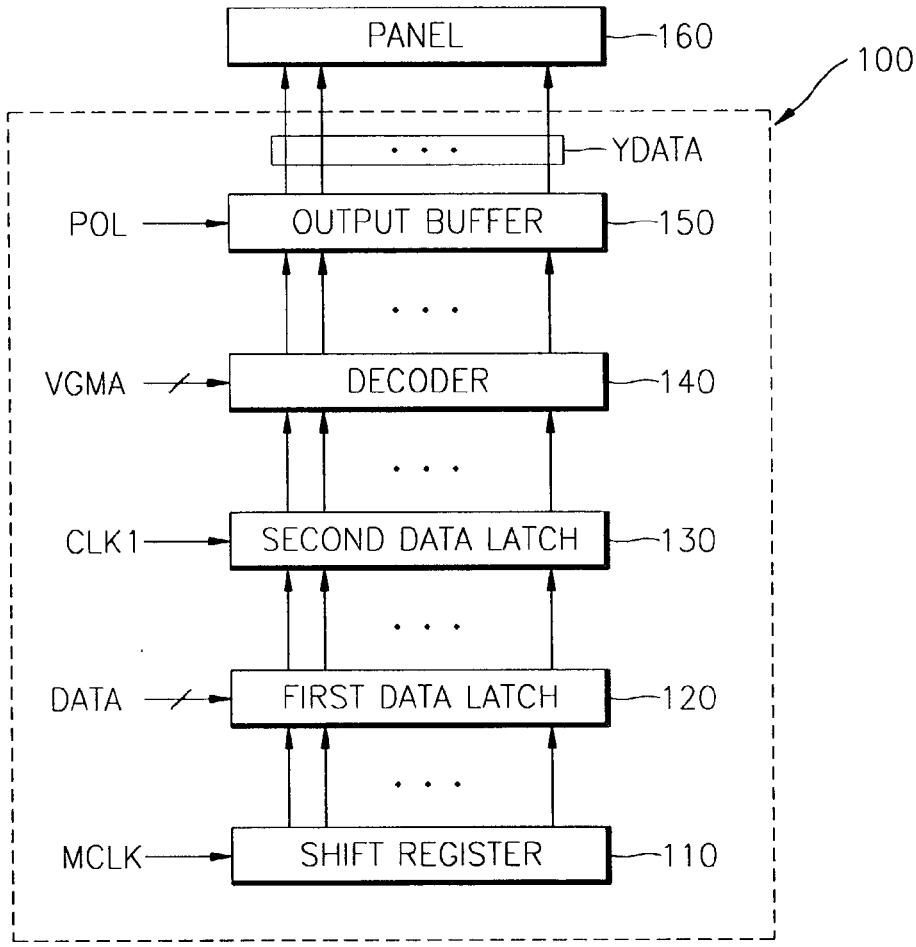
FIG. 1 (PRIOR ART)
FIG. 1 is a block diagram of a conventional source driver circuit for use in a thin film transistor liquid crystal display (LCD)
Figure 2:
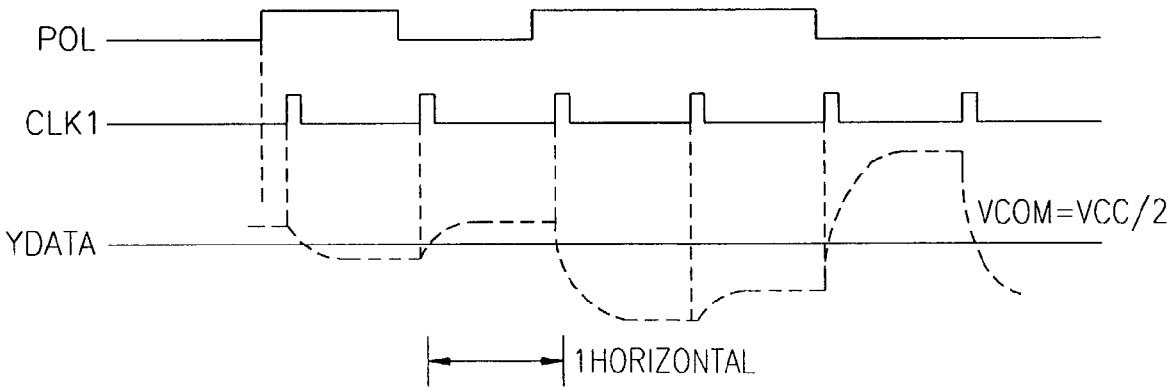
FIG. 2 (PRIOR ART)
FIG. 2 is a timing diagram for explaining the operation of the source driver circuit of FIG. 1.

Hereinafter, a first embodiment of a source driver circuit 300 for use in a thin film transistor liquid crystal display (LCD) according to the present invention will be described with reference to FIGS. 3 through 5. The source driver circuit 300 includes a data latching unit 380, a switch buffering unit 390 and an output controller 395.

The data latching unit 380 receives and stores color data DATA in response to a main clock signal MCLK, and outputs the stored color data DATA in response to a predetermined first signal CTRLS1.

The switch buffering unit 390 receives the color data DATA output from the data latching unit 380, and applies the color data DATA to a panel 370 in response to a predetermined second signal CTRLS2.

The output controller 395 generates the first and second signals CTRLS1 and CTRLS2 in response to the main clock signal MCLK, a polarity inversion signal POL, which controls the polarity of voltage of the color data DATA input to the panel 370, and a first clock signal CLK1. Preferably, the first signal CTRLS1 is activated for a predetermined time in response to a rising edge or falling edge of the polarity inversion signal POL whenever the phase of the polarity inversion signal POL is inverted. If the phase of the polarity inversion signal POL does not change, the first clock signal CLK1 is output as the first signal CTRLS1.

Also, the second signal CTRLS2 is deactivated in response to a rising edge or falling edge of the polarity inversion signal POL whenever the phase of the polarity inversion signal POL is inverted, is activated in response to a rising edge of the first clock signal CLK1, and is maintained in its current state when the phase of the polarity inversion signal POL does not change.

Figure 5:
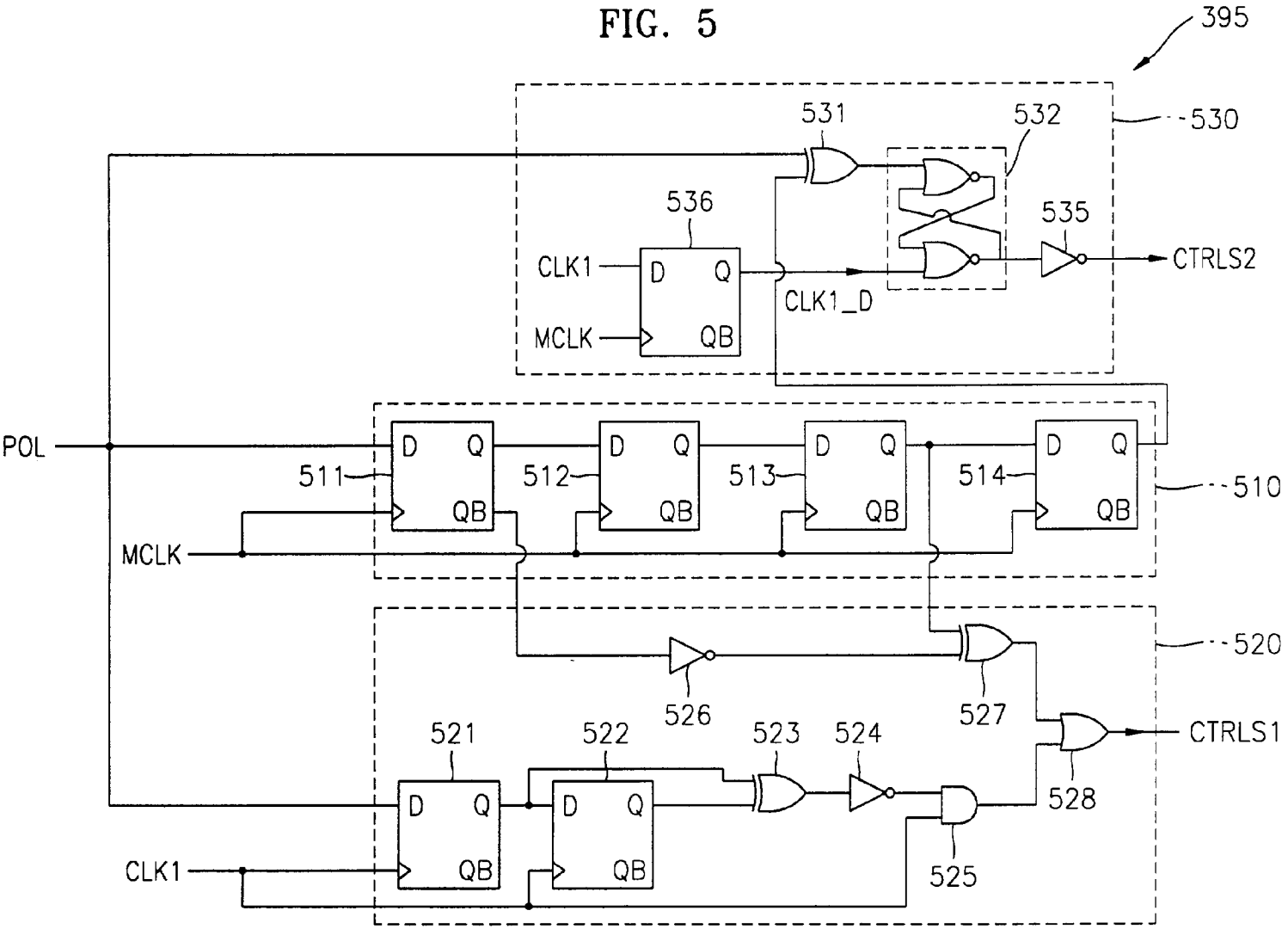
FIG. 5 is a circuit diagram of the output controller of FIG. 3.

With reference to FIG. 5, preferably, the output controller 395 includes a delayer 510 that receives the polarity inversion signal POL in response to the main clock signal MCLK, delays the polarity inversion signal POL for a predetermined time, and outputs the delayed polarity inversion signal POL; a first signal generator 520 that receives the polarity inversion signal POL in response to the first clock signal CLK, generates a first signal, which is activated whenever the phase of the polarity inversion signal POL is inverted, and outputs the first clock signal CLK1 as the first signal CTRLS1 if the phase of the polarity inversion signal POL does not change; and a second signal generator 530 that receives the polarity inversion signal POL, a signal output from the delayer 510 and a predetermined delayed first clock signal CLK1_D, and generates a second signal CTRLS2 that is deactivated in response to a rising edge or falling edge of the polarity inversion signal POL, is activated in response to a rising edge of the first clock signal CLK1, and is maintained when the phase of the polarity inversion signal POL does not change.

The second signal generator 530 further includes a delay clock unit 536 that receives the first clock signal CLK1 in response to the main clock signal MCLK, delays it for a predetermined time, and generates the delayed first clock signal CLK1_D.

The delayer 510 includes a plurality of flip flops. The first signal generator 520 includes first and second flip flops 521 and 522 that receive, delay and output the polarity inversion signal POL in response to the first clock signal CLK1; a second X-OR means 523 that receives signals output from the first and second flip flops 521 and 522, and performs an X-OR operation on these signals; a second inverter 524 that inverts an output of the second X-OR means 523 and outputs it; an AND means 525 that performs an AND operation on an output of the second inverter 524 and the first clock signal CLK1;

a third X-OR means 527 that performs an X-OR operation on a signal that is an inverted signal of the inverted output from the first flip flop 511 among flip flops of the delayer 510, and a signal output from the third flip flop 513; and an OR means 528 that performs an OR operation on outputs from the third X-OR means 527 and the AND means 525, and outputs the result as the first signal CTRLS1.

The second signal generator 530 includes a first X-OR means 531 that receives the polarity inversion signal POL and a signal output from the delayer 510, and performs an X-OR operation on these signals; an SR latch 532 that receives and outputs an output from the first X-OR means 531 and the delayed first clock signal CLK1_D; and a first inverter 535 that inverts an output from the SR latch 532 and outputs it as the second signal CTRLS2.

Hereinafter, the operation of the first embodiment of a source driver circuit according to the present invention will be described in detail with reference to FIGS. 3 through 5.

The data latching unit 380 receives and stores color data DATA in response to the main clock signal MCLK, and outputs the stored color data DATA in response to the predetermined first signal CTRLS1.

More specifically, the main clock signal MCLK is input to the first data latch 320 by a shift register 310 in the data latching unit 380, and the color data DATA is synchronized with the main clock signal MCLK and applied to the first data latch 320 included in the data latching unit 380. The color data DATA latched by the first data latch 320 is input to the second data latch 330 and output by the second data latch 330 in response to the first signal CTRLS1.

Figure 4:
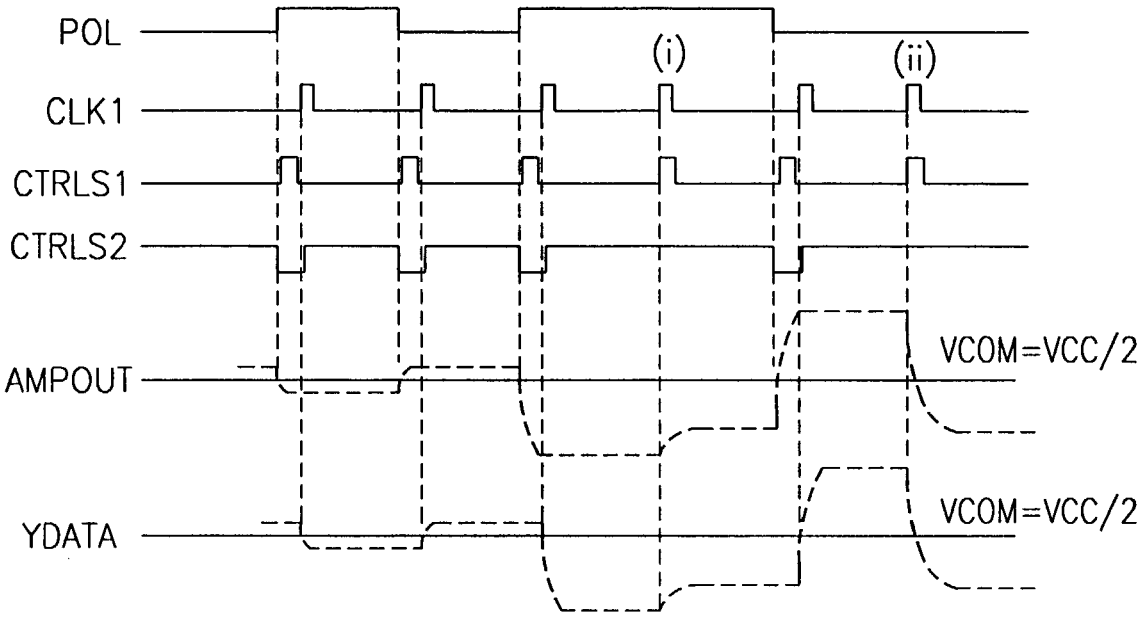
FIG. 4 is a timing diagram for explaining the operation of the source driver circuit of FIG. 3.

Referring to FIG. 4, the first signal CTRLS1 is activated for a predetermined time in response to a rising edge or falling edge of the polarity inversion signal POL whenever the phase of the polarity inversion signal POL is inverted, but the first clock signal CLK1 is output as the first signal CTRLS1 in the event that the phase of the polarity inversion signal POL does not change.

The first signal CTRLS1 is generated by the output controller 395. The structure and functions of the output controller 395 will be described below.

In response to the first signal CTRLS1, the color data DATA is transmitted from the data latching unit 380 to the output buffer 350 of the switch buffering unit 390. As can be seen from FIG. 4, the color data DATA is output from the output buffer 350 in an activation period of the first signal CTRLS1, i.e., a period in which the logic level is high. At this time, the polarity of the color data DATA, which is output from the output buffer 350, changes with respect to a reference voltage VCOM in response to the polarity inversion signal POL. If the phase of the polarity inversion signal POL does not change, which is illustrated at locations (i) and (ii) in FIG. 4, the first clock signal CLK1 is used as the first signal CTRLS1, and thus, the color data DATA is output from the output buffer 350 in response to the first clock signal CTRLS1.

The switch buffering unit 390 receives the color data DATA output from the data latching unit 380 and applies the color data DATA to the panel 370 in response to the predetermined second signal CTRLS2.

In detail, the color data DATA output from the data latching unit 380 reaches a constant voltage level in a decoder 340 included in the switch buffering unit 390 in response to a voltage control signal VGMA. The color data DATA is then applied to the output buffer 350 and output in response to the first signal CTRLS1. In response to the second signal CTRLS2, the output switch 360 in the switch buffering unit 390 is controlled to output color data YDATA to the panel 370. The output switch 360 includes a plurality of switches that are turned on or off when the second signal CTRLS2 is activated or deactivated.

The second signal CTRLS2 is deactivated in response to a rising edge or falling edge of the polarity inversion signal POL whenever the phase of the polarity inversion signal POL changes, is activated in response to a rising edge of the first clock signal CLK1, and is maintained in the event that the phase of the polarity inversion signal POL does not change.

The second signal CTRLS2 is generated by the output controller 395. The structure and functions of the output controller 395 will be described later.

If the color data DATA reaches the output switch 360 in response to the first signal CTRLS1 and the second signal CTRLS2 is activated to a high level, the output switch 360 is turned on to output the color data YDATA to the panel 370. During the activation of the second signal CTRLS2 to a high level, the first signal CTRLS1 is deactivated to a low level. That is, while the color data YDATA is output to the panel 370 from the output switch 360 in response to the second signal CTRLS2, the color data DATA applied to the data latching unit 380 is stored in the second data latch 330. Then, if all the color data YDATA is output to the panel 370 from the output switch 360, i.e., the second signal CTRLS2 is deactivated to a low level, the first signal CTRLS1 is activated to a high level, and the color data DATA stored in the second data latch 320 is applied to the output buffer 350.

The time required for activating the second signal CTRLS2 to a high level is the same as the time for activating the first clock signal CLK1 to a high level. In other words, although the time needed to apply the color data YDATA to the panel 370 from the output switch 360 in the switch buffering unit 390 is the same as in the conventional source driver circuit 100 of FIG. 1, the color data DATA stored in the data latching unit 380 is sent to the output buffer 350 prior to the application of the first clock signal CLK1, according to the present invention. Thus, in the event that the first clock signal CLK1 reaches a high level, that is, the second signal CTRLS2 has a high level, the color data YDATA is output directly to the panel 370 from the output switch 360.

In the conventional source driver circuit 100, after the generation of the first clock signal CLK1, the time required for the color data DATA to pass through the first and second data latches 320 and 330, the decoder 340, and the output buffer 350 is included in the slew rate of the color data YDAMA input to the panel 370. However, according to the present invention, the color data DATA is transmitted to the output buffer 350 before the generation of the first clock signal CLK1, and therefore, the slew rate of the color data YDATA input to the panel 370 from the output switch 360 can be remarkably reduced.

Hereinafter, the structure and operation of the output controller 395 that generates the first and second signals CTRLS1 and CTRLS2 will be described.

With reference to FIG. 5, the output controller 395 generates first and second signals CTRLS1 and CTRLS2 in response to the main clock signal MCLK, the polarity inversion signal POL that controls the polarity of the voltage of the color data YDATA input to the panel 370, and the first clock signal CLK1.

Preferably, the output controller 395 includes a delayer 510, a first signal generator 520 and a second signal generator 530.

The delayer 510 receives the polarity inversion signal POL in response to the main clock signal MCLK, delays it for a predetermined time, and outputs it. The delayer 510 includes a plurality of flip flops 511 through 514.

The first signal generator 520 receives the polarity inversion signal POL in response to the first clock signal CLK1, generates a first signal that is activated whenever the phase of the polarity inversion signal POL is inverted, and outputs the first clock signal CLK1 as the first signal CTRLS1 when the phase of the polarity inversion signal POL does not change. To perform this operation, the first signal generator 520 includes first and second flip flops 521 and 522, X-OR means 523 and 527, inverters 524 and 526, an AND means 525, and an OR means 528.

The first and second flip flops 521 and 522 are actuated in response to the first clock signal CLK1, receive and delay the polarity inversion signal POL, and apply the delayed polarity inversion signal POL to the second X-OR means 523. In addition, the first flip flop 521 delays the polarity inversion signal POL and applies it to the second X-OR means 523. An output of the second X-OR means 523 is input to the AND means 525 via the second inverter 524. The first clock signal CLK1 is also input to the AND means 525.

If the output of the second inverter 524 is at a high level, the output of the second X-OR means 523 is at a low level. This means that two signals input to the second X-OR means 523 have the same logic level. That is, signals obtained by delaying the polarity inversion signal POL by the first and second flip flops 521 and 522 have the same logic levels, which means the logic level of the polarity inversion signal for a predetermined time. Here, the output from the second inverter 524, which is input to the AND means 525, has a high level, and thus the output of the AND means 525 becomes the same as the first clock signal CLK1.

The logic level of the polarity inversion signal POL, which is in synchronization with the first clock signal CLK1, does not change for a predetermined time, and thus, the output of the third flip flop 513 of the delayer 510, and the output of the third X-OR means 527, which receives the inverted output of the first flip flop 511 via the inverter 526, are at low levels. Because a period of the main clock signal MCLK is far shorter than that of the first clock signal CLK1, the logic level of the polarity inversion signal POL in synchronization with the main clock signal MCLK does not change if the logic level of the polarity inversion signal POL in synchronization with the first clock signal CLK1 does not change. Alternatively, the signals input to the third X-OR means 527 may not be output from the first and third flip flops 511 and 513, and may be polarity inversion signals POL that are delayed for different times. The third X-OR means 527 detects whether the logic level of the polarity inversion signal POL changes or not.

Therefore, since an output of the third X-OR means 527 has a low level, the first signal CTRLS1, which is an output of the OR means 528, becomes the same as the output of the AND means 525. Also, the output of the AND means 525 is the same as the first clock signal CLK1. For this reason, if the logic level of the polarity inversion signal POL does not change, the first clock signal CLK1 is output as the first signal CTRLS1, indicated as locations (i) and (ii) in FIG. 4. From the locations (i) and (ii), it is noted that the first clock signal CLK1 is output as the first signal CTRLS1. Thus, the outputs of the output buffer 350 and the output switch 360 are output in the same format as the conventional source driver circuit 100 of FIG. 1.

When the logic level of the polarity inversion signal POL changes, the output of the third X-OR means 527 is activated to a high level. Thus, the OR means 528 outputs a high level as the first signal CTRLS1 irrespective of the logic level of the AND means 525. That is, the first signal CTRLS1 is activated for a predetermined time in response to a rising edge or falling edge of the polarity inversion signal POL when the logic level of the polarity inversion signal POL changes.

The second signal generator 530 receives the polarity inversion signal POL, a signal output from the delayer 510, and a predetermined delayed first clock signal CLK1_D, and generates the second signal CTRLS2, which is deactivated in response to a rising edge or falling edge of the polarity inversion signal POL, is activated in response to a rising edge of the first clock signal CLK1, and is maintained at the same level in the event that the phase of the polarity inversion signal POL does not change. As mentioned above, to perform these operations, the second signal generator 530 includes the first X-OR means 531, the SR latch 532, and the first inverter 535. Also, the second signal generator 530 further includes a delay clock unit 536 that receives the first clock signal CLK1 in response to the main clock signal MCLK, delays the received first clock signal CLK1 for a predetermined time, and outputs the result as the delayed first clock signal CLK1_D.

When the logic level of the polarity inversion signal POL changes, the output of the first X-OR means 531 is activated to a high level, and the output of the SR latch 532 is also activated to a high level according to its operational characteristics. Thus, the second signal CTRLS2, which is the output of the first inverter 535, is deactivated to a low level. In other words, whenever the logic level of the polarity inversion signal POL changes, a low level is output as the second signal CTRLS2. Unless the logic level of the polarity inversion signal POL changes, the output of the first X-OR means 531 is at a low level. Then, if the delayed first clock signal CLK1_D, which is made by delaying the first clock signal CLK1 for a predetermined time, has a high level, the output of the SR latch 532 reaches a low level. Therefore, the second signal CTRLS2, which is the output of the first inverter 535, is at a high level. The second signal CTRLS2 is maintained at a high level until the phase of the polarity inversion signal POL changes, and its level falls to a low level when the phase of the polarity inversion signal POL changes.

As can be seen from the timing diagram of FIG. 4, the first signal CTRLS1 is activated to a high level for a delay time by the first and third flip flops 511 and 513 of the delayer 510 in response to a rising edge or falling edge of the polarity inversion signal POL, and then falls to a low level. However, in the event that the logic level of the polarity inversion signal POL does not change, the first clock signal CLK1 is output as the first signal CTRLS1.

The second signal CTRLS2 falls to a low level in response to a rising edge or falling edge of the polarity inversion signal POL, and is activated to a high level in response to a rising edge of the first clock signal CLK1. The second signal CTRLS2 is activated to a high level after a rising edge of the first clock signal CLK1 due to a the delay caused by the delay clock unit 536.

For this reason, a period in which the first signal CTRLS1 is activated to a high level does not overlap with a period in which the second signal CTRLS2 is activated to a high level. Thus, the first signal CTRLS1 is activated to transmit color data DATA, which was applied to the data latching unit 380, to the output buffer 350 of the switch buffering unit 390. Then, if the first signal CTRLS1 is deactivated to a low level and the second signal CTRLS2 is activated to a high level, the output switch 360 is turned on and the color data YDATA output from the output switch 360 is applied to the panel 370.

If the second signal CTRLS2 is deactivated to a low level, the first signal CTRLS1 is activated to a high level, and, as a result, the color data DATA output from the data latching unit 380 is applied to the switch buffering unit 390. Therefore, although the color data YDATA is applied to the panel 370 at the same time when a first clock signal CLK1 is generated in the conventional source driver circuit 100, the slew rate of the color data YDATA, which is applied to the panel 370 from the output switch 360, can be reduced more than in the conventional source driver circuit 100.

The source driver circuit 300 according to the present invention can reduce the slew rate of the color data YDATA applied to the panel 370, using existing signals, without generating additional signals external to the semiconductor chip. Also, the source driver circuit 300 is applicable to an N-line inversion source driver circuit as well as a dot inversion source driver circuit.

In the source driver circuit 300 of the present invention, a switching current caused by the simultaneous switching of the level shifter and the output buffer is reduced, and the size of a driving transistor, which is used in the output buffer for the reduction in the slew rate of color data, can be reduced, thereby reducing the power consumption and the chip size.

Here, it is described that the first signal CTRLS1 and the second signal CTRLS2 are activated to high levels and deactivated to low levels. However, it is possible for these signals to be activated to low levels and deactivated to high levels, depending on the structure of the circuit.

Hereinafter, a second embodiment of a source driver circuit 300 for use in a thin film transistor LCD according to the present invention will be described with reference to FIGS. 3 through 5. The source driver circuit 300 includes a data latching unit 380 and a switch buffering unit 390.

The data latching unit 380 receives and stores color data DATA in response to a main clock signal MCLK, and outputs the stored color data DATA in response to a predetermined first signal CTRLS1.

The switch buffering unit 390 receives the color data DATA output from the data latching unit 380, and applies the color data DATA to a panel 370 in response to a predetermined second signal CTRLS2.

Preferably, the first signal CTRLS1 is activated for a predetermined time in response to a rising edge or falling edge of a polarity inversion signal POL whenever the phase of the polarity inversion signal POL is inverted. If the phase of the polarity inversion signal POL does not change, a first clock signal CLK1 is output as the first signal CTRLS1.

Also, the second signal CTRLS2 is deactivated in response to the rising edge or falling edge of the polarity inversion signal POL whenever the phase of the polarity inversion signal POL is inverted, is activated in response to a rising edge of the first clock signal CLK1, and is maintained at the same level if the phase of the polarity inversion signal POL does not change.

It is assumed that those skilled in the art can appreciate the difference in operation of the second embodiment of the source driver circuit 300 according to the present invention from that of the first embodiment of the source driver circuit 300. Therefore, a detailed explanation of the second embodiment of the source driver circuit 300 will be omitted.

Hereinafter, a third embodiment of a source driver circuit 300 for use in a thin film transistor LCD according to the present invention will be described with reference to FIGS. 3 through 5. The source driver circuit 300 includes a first data latch 320, a second data latch 330, a decoder 340, an output buffer 350, an output switch 360, and an output controller 395.

The first data latch 320 receives and stores color data DATA in response to a main clock signal MCLK. The second data latch 330 receives and stores the color data DATA output from the first data latch 320, and outputs it in response to a predetermined first signal CTRLS1. The decoder 340 decodes the color data DATA, output from the second data latch 330 indicating constant predetermined voltage in response to a predetermined voltage control signal VGMA. The output buffer 350 receives, buffers and outputs the color data DATA output from the decoder 340. The output switch 360 applies or blocks the color data DATA to or from the panel 370 in response to a predetermined second signal CTRLS2.

The output controller 395 generates the first signal CTRLS1 or the second signal CTRLS2 in response to the main clock signal MCLK, a polarity inversion signal POL that controls the polarity of voltage of the color data DATA input to the panel 370, and a first clock signal CLK1.

The output controller 395 includes a delayer 510 that receives the polarity inversion signal POL in response to the main clock signal MCLK, delays it for a predetermined time, and outputs it; a first signal generator 520 that receives the polarity inversion signal POL in response to the first clock signal CLK1, generates the first signal CTRLS1 that is activated whenever the phase of the polarity inversion signal POL is inverted, and outputs the first clock signal CLK1 as the first signal CTRLS1 when the phase of the polarity inversion signal POL does not change; and a second signal generator 530 for receiving the polarity inversion signal POL, a signal output from the delayer 510, and a predetermined delayed first clock signal CLK1_D, and generating the second signal CTRLS2 that is deactivated in response to a rising edge or falling edge of the polarity inversion signal POL, is activated in response to a rising edge of the first clock signal CLK1, and is maintained at the same level when the phase of the polarity inversion signal POL does not change.

The second signal generator 530 further includes a delay clock unit 536 that receives the first clock signal CLK1 in response to the main clock signal MCLK, delays it for a predetermined time, and outputs it as a delayed first clock signal CLK1_D. The delayer 510 includes a plurality of flip flops 511 through 514. The first signal generator 520 includes first and second flip flops 521 and 522 that receive the polarity inversion signal POL in response to the first clock signal CLK1, and delay and output it; a second X-OR means 523 that receives signals output from the first and second flip flops 521 and 522, and performs an X-OR operation on these signals; a second AND means 524 that inverts an output of the second X-OR means 523 and outputs it; an AND means 525 that performs an AND operation on the output of the second inverter 524 and the first clock signal CLK1; a third X-OR means 527 that performs an X-OR operation on a signal that is the inverted signal of the inverted output from the first flip flop 511 of the delayer 510, and a signal output from the third flip flop 513; and an OR means 528 that performs an OR operation on outputs of the third X-OR means 527 and the AND means 525, and outputs the result as the first signal CTRLS1.

The second signal generator 530 includes a first X-OR means 531 that receives the polarity inversion signal POL and signals output from the delayer 510, and performs an X-OR operation on them; an SR latch 532 that receives and outputs an output of the first X-OR means 531 and the delayed first clock signal CLK1_D; and a first inverter 535 that inverts an output of the SR latch 532 and outputs it as the second signal CTRLS2.

It is also regarded that those skilled in this art can understand the operation of the third embodiment of the source driver circuit 300 according to the present invention and can distinguish the operation of the third embodiment from that of the first embodiment of the source driver circuit 300. Therefore, detailed explanations on the third embodiment of the source driver circuit 300 will be omitted.

Figure 6:
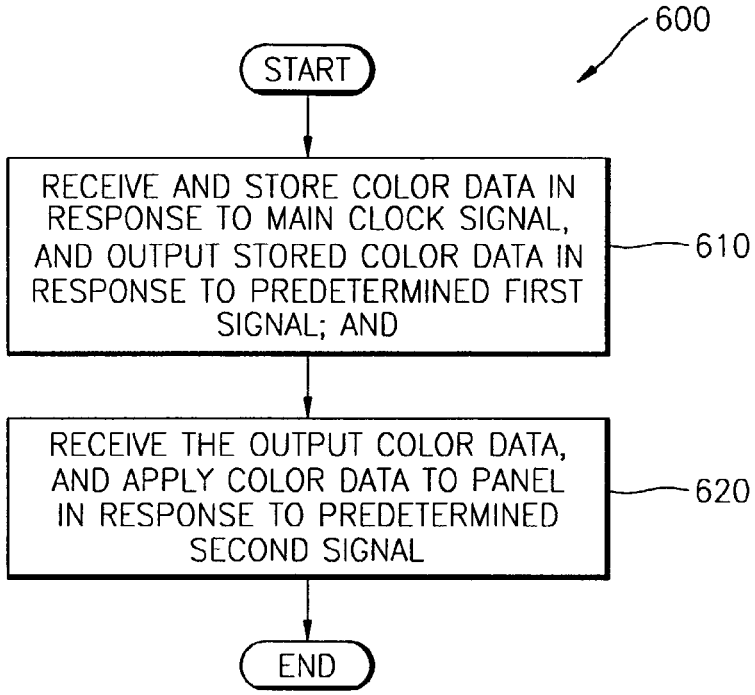
FIG. 6 is a flow diagram of a method of adjusting the slew rate of color data applied to a panel in the first embodiment of a source driver circuit for use in a thin film transistor LCD.
Figure 7:
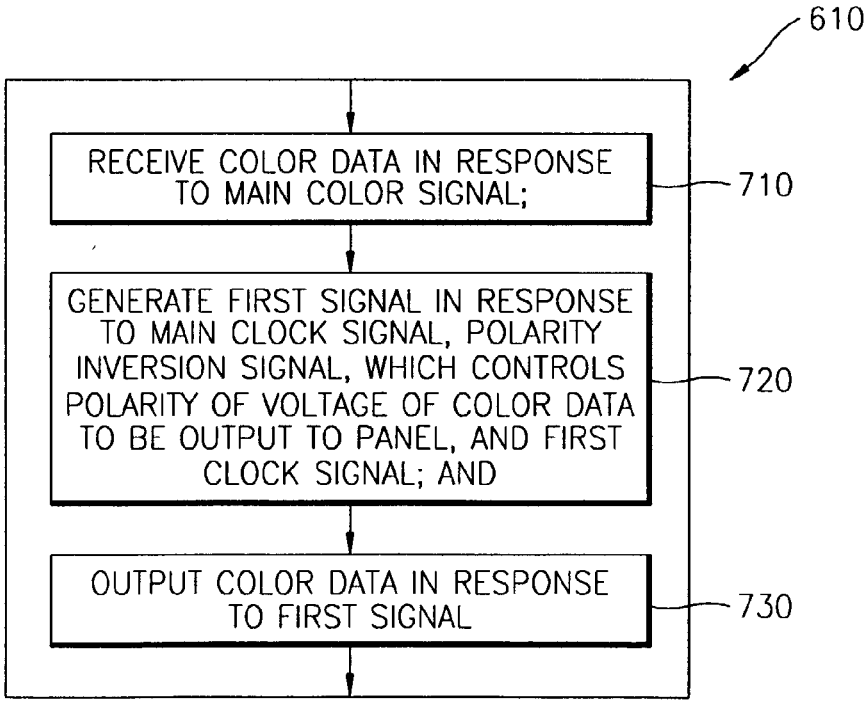
FIG. 7 is a flow chart of step 610 of FIG. 6.
Figure 8:
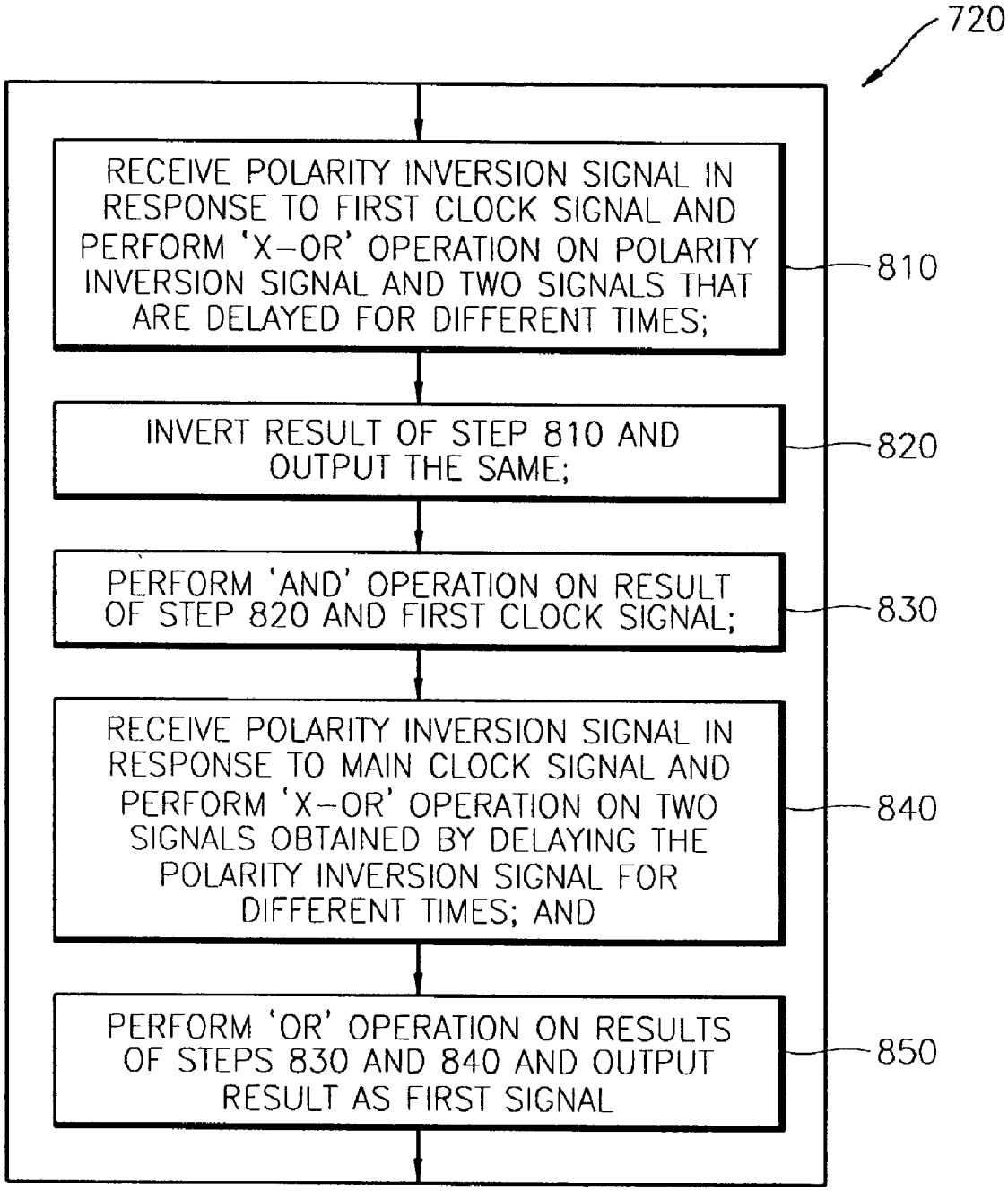
FIG. 8 is a flow chart of step 720 of FIG. 7.
Figure 9:
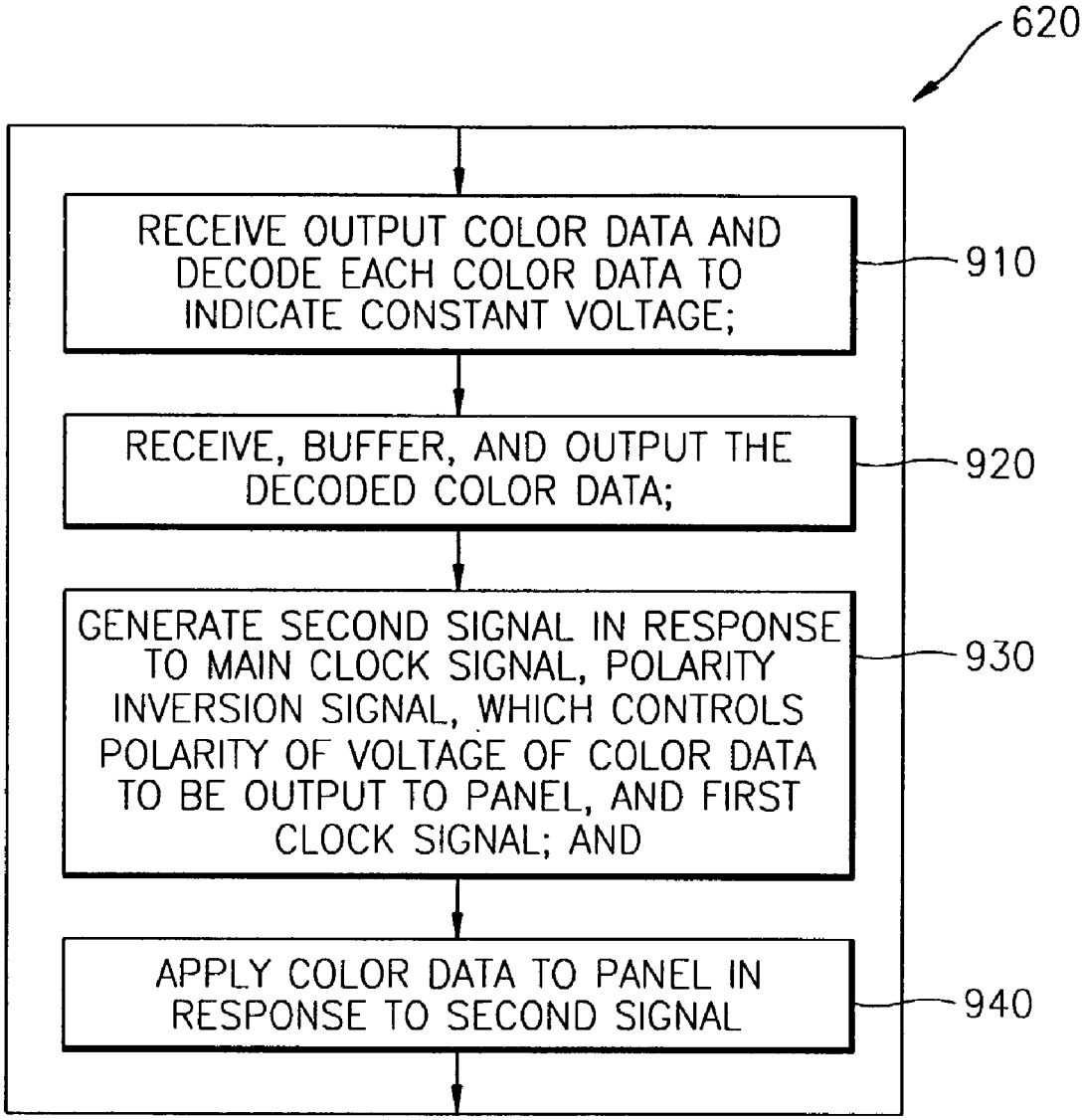
FIG. 9 is a flow chart of step 620 of FIG. 6.
Figure 10:
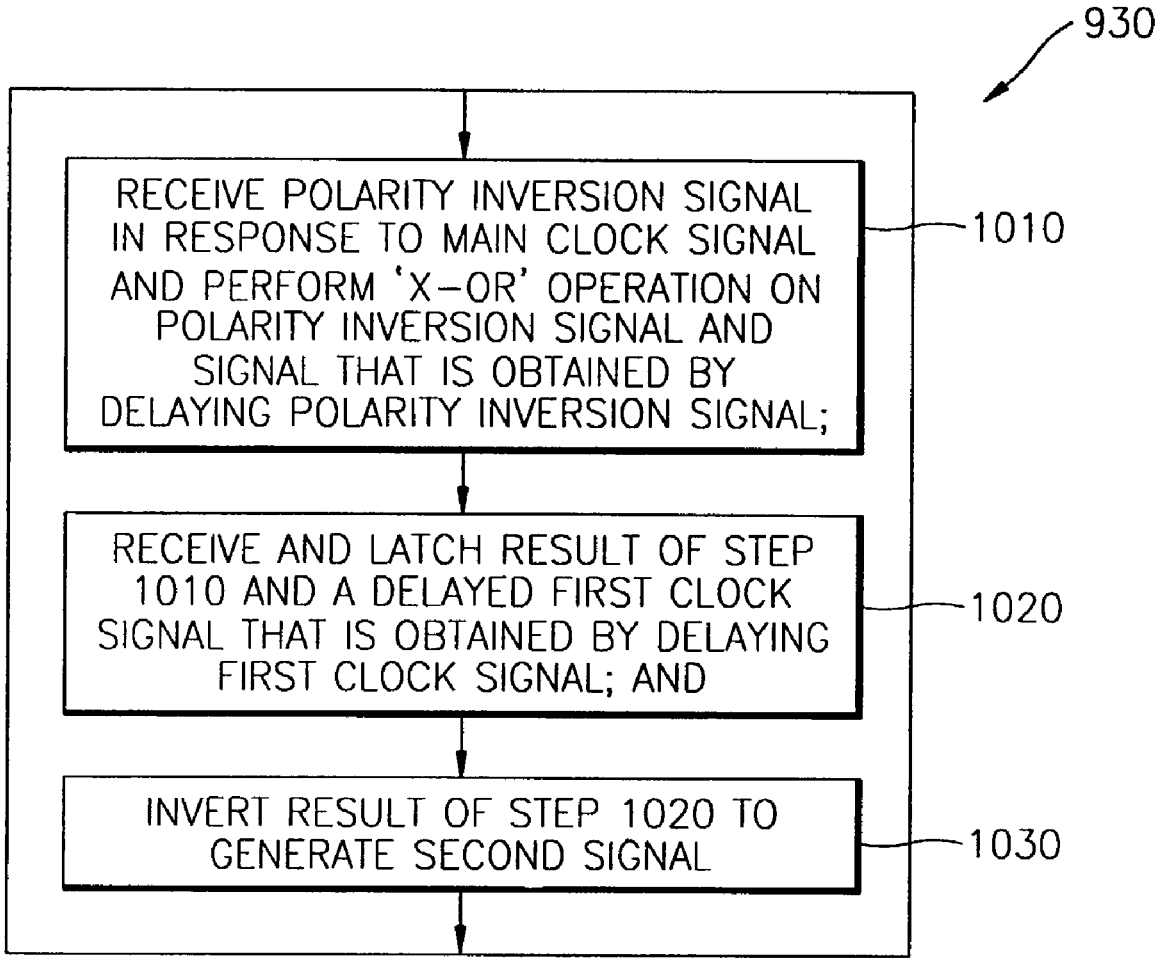
FIG. 10 is a flow chart of step 930 of FIG. 9.

FIG. 6 is a flow chart explaining a method 600 of adjusting the slew rate of color data applied to the panel 370 in the first embodiment of a source driver circuit for use in a thin film transistor LCD. FIG. 7 is a flow chart explaining step 610 of FIG. 6. FIG. 8 is a flow chart explaining step 720 of FIG. 7. FIG. 9 is a flow chart explaining step 620 of FIG. 6. FIG. 10 is a flow chart explaining step 930 of FIG. 9.

Referring to FIGS. 6 through 10, the method 600 includes receiving and storing color data in response to a main clock signal, and outputting the stored color data in response to a predetermined first signal (step 610); and receiving the output color data, and applying it to a panel in response to a predetermined second signal (step 620).

More specifically, referring to FIG. 7, step 610 includes receiving and storing the color data in response to the main clock signal (step 710); generating the first signal in response to the main clock signal, a polarity inversion signal that controls the polarity of voltage of the color data, which is to be input to the panel, and a first clock signal (step 720); and outputting the color data in response to the first signal (step 730).

Referring to FIG. 8, step 720 includes receiving the polarity inversion signal in response to the first clock signal, and performing an X-OR operation on two signals obtained by delaying the polarity inversion signal for different times (step 810); inverting and outputting the result of step 810 (step 820); performing an AND operation on the result of step 820 and the first clock signal (step 830); receiving the polarity inversion signal in response to the main clock signal, and performing an X-OR operation on two signals obtained by delaying the polarity inversion signal for different times (step 840); and performing an OR operation on the results of steps 830 and 840, and outputting the final result as the first signal (step 850).

Referring to FIG. 9, step 620 includes receiving the output color data, and decoding the color data to indicate constant voltage (step 910); receiving, buffering and outputting the decoded color data (step 920); generating the second signal in response to the main clock signal, the polarity inversion signal that controls the polarity of voltage of the color data, which is to be output to the panel, and the first clock signal (step 930); and applying the color data to the panel in response to the second signal (step 940).

Referring to FIG. 10, step 930 includes receiving the polarity inversion signal in response to the main clock signal, and performing an X-OR operation on the polarity inversion signal and a signal that is made by delaying the polarity inversion signal (step 1010); receiving and latching the result of step 1010 and a delayed first clock signal (1020); and generating the second signal by inverting the result of step 1020 (1030).

Hereinafter, the method 600 of adjusting the slew rate of color data applied to a panel will be described in detail with reference to FIGS. 6 through 10.

Figure 3:
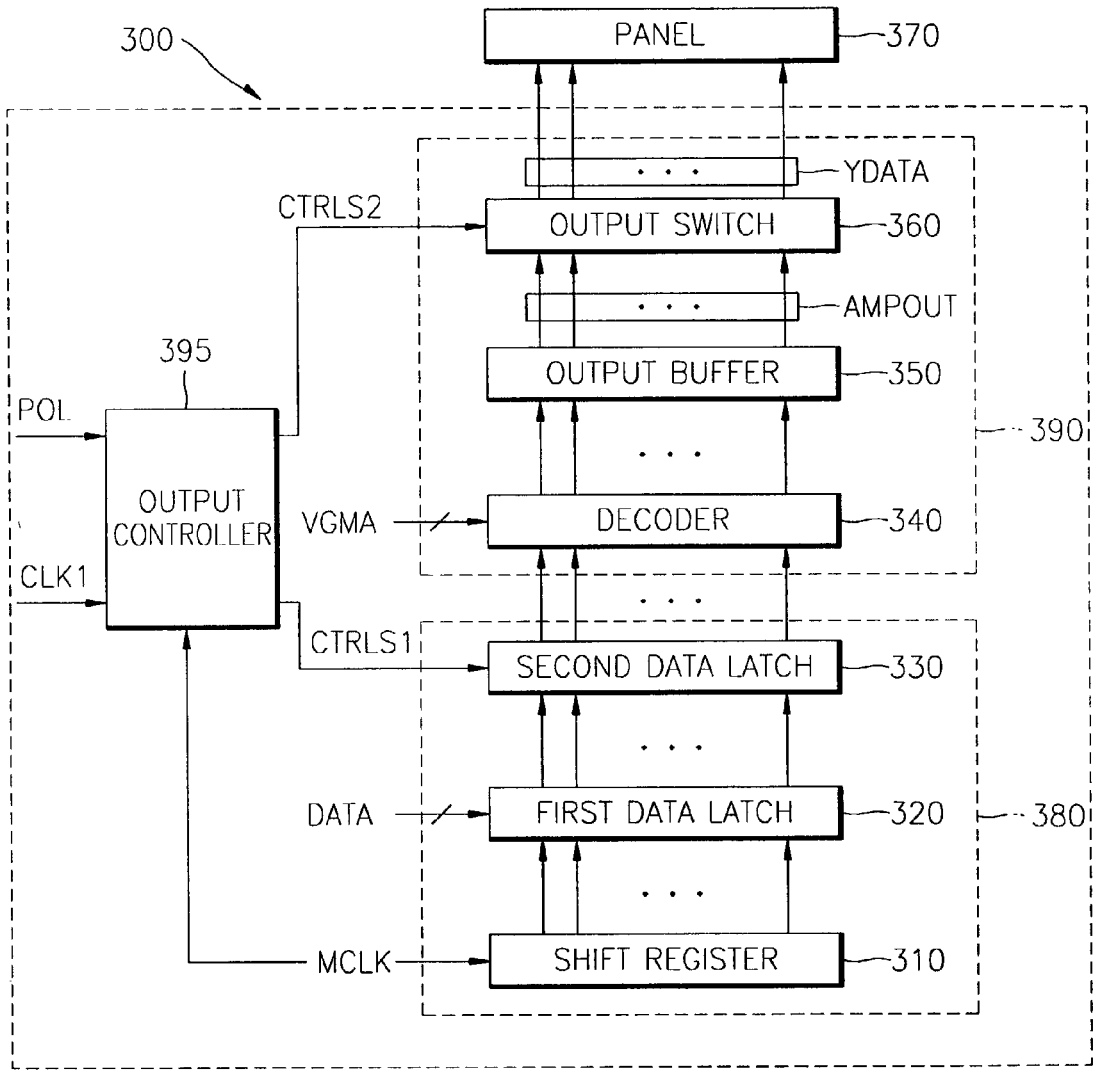
FIG. 3 is a block diagram of a source driver circuit for use in a thin film transistor LCD according to the present invention.

The method 600 is performed by a source driver circuit for use in the thin film transistor LCD according to the present invention as illustrated in FIG. 3.

First, the source driver circuit receives and stores color data in response to a main clock signal, and outputs the stored color data in response to a predetermined first signal (step 610).

More specifically, the source driver circuit receives and stores the color data in response to the main clock signal (step 710). The main clock signal is input to a shift register included in the source driver circuit, and the shift register shifts and outputs the input main clock signal. The color data is synchronized with the main clock signal output from the shift register, and input to and stored in the source driver circuit.

Secondly, the source driver circuit generates the first signal in response to the main clock signal, a polarity inversion signal that controls the polarity of voltage of the color data, and a first clock signal (step 720). In detail, the first signal is activated for a predetermined time in response to a rising edge or falling edge of the polarity inversion signal whenever the phase of the polarity inversion signal is inverted. However, in the event that the phase of the polarity inversion signal does not change, the first clock signal is output as the first signal.

Lastly, the source driver circuit transmits the color data in response to the first signal to a stage preceding the panel, e.g., to the output buffer 360 of FIG. 3, and outputs the color data to the panel in response to the second signal.

Here, the first signal is generated as described in the flow chart of FIG. 8. That is, the source driver circuit receives the polarity inversion signal in response to the first clock signal, and performs an X-OR operation on two signals, which are obtained by delaying the polarity inversion signal for different time periods (step 810). Then, the result of step 810 is inverted and output (step 820). Next, an OR operation is performed on the result of step 820 and the first clock signal (step 830). Thereafter, the polarity inversion signal is received in response to the main clock signal, and an X-OR operation is performed on two signals obtained by delaying the polarity inversion signal for different time periods (step 840). Then, an OR operation is performed the results of steps 830 and 840, thereby generating the first signal (step 850).

Thereafter, the source driver circuit outputs the color data in response to the first signal (step 730). In a conventional source driver circuit, color data is applied to a panel in response to a first clock signal, and therefore, the slew rate of the color data applied to the panel includes the time required for the color data to be input to the source driver circuit and output from the source driver circuit. On the other hand, in the method 600 according to the present invention, the first signal is generated prior to the generation of the first clock signal, and thus, the color data is transmitted to the stage prior to the panel, e.g., to the output buffer 370 of FIG. 3, in response to the first signal. Then, the color data is applied to the panel in response to the second signal during the subsequent process. At this time, the second signal is generated at the time when the first clock signal is generated when color data is applied to the panel in the conventional source driver circuit. Nevertheless, the slew rate of the color data output to the panel, according of the present invention, is reduced far more than in the conventional source driver circuit.

Then, the source driver circuit 300 receives the output color data, and applies it to the panel in response to the predetermined second signal (step 620).

More specifically, the source driver circuit 300 receives the output color data, decodes each color data to indicate constant voltage, and receives, buffers and outputs the decoded color data (steps 910 & 920).

Next, the source driver circuit 300 generates the second signal in response to the main clock signal, the polarity inversion signal that controls the polarity of voltage of the color data, which is to be output to the panel, and the first clock signal (step 930). Here, the second signal is deactivated in response to a rising edge or falling edge of the polarity inversion signal whenever the phase of the polarity inversion signal is inverted, is activated in response to a rising edge of the first clock signal, and is maintained at the same level unless the phase of the polarity inversion signal changes.

A method of generating the second signal is as shown in FIG. 10. First, the source driver circuit 300 receives the polarity inversion signal in response to the main clock signal, and performs an X-OR operation on the polarity inversion signal, and a signal that is the delayed polarity inversion signal (step 1010). Next, the source driver circuit 300 receives and latches the result of step 1010 and a delayed first clock signal that is made by delaying the first clock signal (step 1020). Then, the result of step 1020 is inverted and output as the second signal (step 1030).

Once the second signal is obtained, the source driver circuit applies the color data, which was transmitted to the stage prior to the panel, e.g., to the output buffer, to the panel in response to the second signal (step 940). Accordingly, the slew rate of the color data can be reduced.

Here, a period in which the first signal is activated does not overlap with a period in which the second signal is activated. Thus, if the first signal is activated and the color data, which was applied to the source driver circuit, is transmitted to the stage right before the panel, the first signal is deactivated, the second signal is activated, and then, the color data is applied to the panel.

Then, when the second signal is deactivated, the first signal is again activated and the color data is transmitted to the stage prior to the panel. Therefore, although the color data is applied to the panel, according to the present invention, at the time when the first clock signal is generated in the conventional source driver circuit, the slew rate of the color data applied to the panel can be reduced more than in the conventional source driver circuit.

While this invention has been particularly described with reference to preferred embodiments-thereof, it will be understood by those skilled in the art that various changes in form and details may be made therein without departing from the spirit and scope of the invention as defined by the appended claims.

As described above, in a source driver circuit and a method of reducing the slew rate of color data according to the present invention, the slew rate of the color data, which is to be applied to a panel, can be reduced using the existing signals, without the need for generating additional signals external to the semiconductor chip. Also, in this source driver circuit, a switching current caused by the switching of a shift register and an output buffer is reduced, and the size of a driving transistor that is used to reduce the slew rate of color data can be reduced, thereby reducing power consumption and the size of the resulting chip.

What is claimed is:

1. A source driver circuit for use in a thin film transistor LCD comprising:

a data latching unit for receiving and storing color data in response to a main clock signal, and for outputting the stored color data in response to a first control signal;

a switching buffering unit for receiving the color data output from the data latching unit, and applying the color data to a panel in response to a second control signal; and an output controller that controls a state of the first control signal in response to combined states of more than one of the main clock signal, a polarity inversion signal that controls the polarity of voltage of the color data output to the panel, and a first clock signal and that controls a state of the second control signal in response to combined states of more than one of the main clock signal, the polarity inversion signal, and the first clock signal.

2. The source driver circuit of claim 1, wherein the first control signal is activated in response to a rising edge or falling edge of the polarity inversion signal whenever the phase of the polarity inversion signal is inverted, and wherein the first clock signal is output as the first control signal when the phase of the polarity inversion signal does not change.

3. The source driver circuit of claim 1, wherein the second control signal is deactivated in response to a rising edge or falling edge of the polarity inversion signal whenever the phase of the polarity inversion signal is inverted, activated in response to a rising edge of the first clock signal, and maintained at the same level when the phase of the polarity inversion signal does not change.

4. The source driver circuit of claim 1, wherein the output controller comprises:

a delayer for receiving the polarity inversion signal in response to the main clock signal, and for delaying and outputting the polarity inversion signal for a predetermined time;

a first control signal generator for receiving the polarity inversion signal in response to the first clock signal, generating the first control signal that is activated whenever the phase of the polarity inversion signal is inverted, and outputting the first clock signal as the first control signal when the phase of the polarity inversion signal does not change; and a second control signal generator for receiving the polarity inversion signal, a signal output from the delayer, and a delayed first clock signal, and generating the second control signal that is deactivated in response to a rising edge or falling edge of the polarity inversion signal, is activated in response to a rising edge of the first clock signal, and is maintained at the same level when the phase of the polarity inversion signal does not change.

5. The source driver circuit of claim 4, wherein the second control signal generator further includes a delay clock unit that receives the first clock signal in response to the main clock signal, delays the first clock signal for a predetermined time, and outputs it as a delayed first clock signal.

6. The source driver circuit of claim 4, wherein the delayer comprises a plurality of flip flops.

7. The source driver circuit of claim 4, wherein the first control signal generator comprises:

first and second flip flops for receiving the polarity inversion signal in response to the first clock signal, and delaying and outputting the polarity inversion signal;

a second X-OR means for receiving outputs of the first and second flip flops and performing an X-OR operation on them;

a second inverter for inverting and outputting an output of the second X-OR means;

an AND means for performing an AND operation on an output of the second inverter and the first clock signal;

a third X-OR means for performing an X-OR operation on a signal that is an inverted signal of the inverted output of the first flip flop of the delayer, and a signal output from the third flip flop; and an OR means for performing an OR operation on the outputs of the third X-OR means and the AND means, and outputting the result as the first control signal.

8. The source driver circuit of claim 4, wherein the second control signal generator comprises:

a first X-OR means for receiving the polarity inversion signal and a signal output from the delayer, and performing an X-OR operation on them;

an SR latch for receiving and outputting an output of the first X-OR means and the delayed first clock signal; and a first inverter for inverting an output of the SR latch and outputting it as the second control signal.

9. A method of adjusting the slew rate of color data applied to a panel from a source driver circuit for use in a thin film transistor LCD, the method comprising:

(a) receiving and storing color data in response to a main clock signal, generating a first control signal in response to combined states of more than one of the main clock signal, a polarity inversion signal that controls the polarity of voltage of the color data output to the panel, and a first clock signal, and outputting the stored color data in response to the first control signal; and (b) receiving the output color data, generating a second control signal in response to combined states of more than one of the main clock signal, the polarity inversion signal, and the first clock signal, and applying the color data to a panel in response to the second control signal.

10. The method of claim 9, wherein step (a) comprises:

(a1) receiving and storing the color data in response to the main clock signal;

(a2) generating the first control signal in response to the main clock signal, the polarity inversion signal that controls the polarity of the voltage of the color data, and the first clock signal; and (a3) outputting the color data in response to the first control signal.

11. The method of claim 10, wherein step (a2) comprises:

(a21) receiving the polarity inversion signal in response to the first clock signal, and performing an X-OR operation on two signals obtained by delaying the polarity inversion signal for different time durations;

(a22) inverting and outputting the result of step (a21);

(a23) performing an AND operation on the result of step (a22) and the first clock signal;

(a24) receiving the polarity inversion signal in response to the main clock signal, and performing an X-OR operation on two signals obtained by delaying the polarity inversion signal for different time durations; and (a25) generating the first control signal by performing an OR operation on the results of steps (a23) and (a24).

12. The method of claim 9, wherein the step (b) comprises:

(b1) receiving the output color data, and decoding each of the color data to indicate constant voltage;

(b2) receiving, buffering and outputting the decoded color data;

(b3) generating the second control signal in response to the main clock signal, the polarity inversion signal that controls the polarity of voltage of the color data, and the first clock signal; and (b4) applying the color data to the panel in response to the second control signal.

13. The method of claim 12, wherein step (b3) comprises:

(b31) receiving the polarity inversion signal in response to the main clock signal, and a signal that is the delayed polarity inversion signal, and performing an X-OR operation on these signals;

(b32) receiving and latching the result of step (b31) and a delayed first clock signal that is made by delaying the first clock signal; and (b33) generating the second control signal by inverting the result of step (b32).

14. The method of claim 9, wherein the first control signal is activated for a predetermined time in response to a rising edge or falling edge of the polarity inversion signal whenever the phase of the polarity inversion signal is inverted, and the first clock signal is output as the first control signal when the phase of the polarity inversion signal does not change.

15. The method of claim 9, wherein the second control signal is deactivated in response to a rising edge or falling edge of the polarity inversion signal whenever the phase of the polarity inversion signal is inverted, is activated in response to a rising edge of the first clock signal, and is maintained at the same level when the phase of the polarity inversion signal does not change.

16. A source driver circuit for use in a thin film transistor LCD, the source driver circuit comprising:

a data latching unit for receiving and storing color data in response to a main clock signal, and outputting the stored color data in response to a first control signal, the first control signal being generated in response to combined states of more than one of the main clock signal, a polarity inversion signal that controls the polarity of voltage of the color data output to the panel, and a first clock signal; and a switch buffering unit for receiving the color data output from the data latching unit, and applying the color data to a panel in response to a second control signal, the second control signal being generated in response to combined states of more than one of the main clock signal, the polarity inversion signal, and the first clock signal.

17. The source driver circuit of claim 16, wherein the first control signal is generated in response to the main clock signal, the polarity inversion signal that controls the polarity of voltage of the color data, and the first clock signal, and activated for a predetermined time in response to a rising edge or falling edge whenever the phase of the polarity inversion signal is inverted, and wherein the first clock signal is output as the first control signal when the phase of the polarity inversion signal does not change.

18. The source driver circuit of claim 16, wherein the second control signal is generated in response to the main clock signal, the polarity inversion signal that controls the polarity of the voltage of the color data input to the panel, and the first clock signal; is deactivated in response to a rising edge or falling edge of the polarity inversion signal whenever the phase of the polarity inversion signal is inverted; is activated in response to a rising edge of the first clock signal; and is maintained at the same level when the phase of the polarity inversion signal does not change.

19. A source driver circuit for use in a thin film transistor LCD, the source driver circuit comprising:

a first data latch for receiving and storing color data in response to a main clock signal;

a second data latch for receiving and storing the color data output from the first data latch, and outputting the stored color data in response to a first control signal;

a decoder for decoding each color data output from the second data latch to have a constant voltage level in response to a voltage control signal;

an output buffer for receiving, buffering and outputting the color data output from the decoder;

an output switch for applying or retaining the color data, which is output from the output buffer, to a panel in response to a second control signal; and an output controller that controls a state of the first control signal in response to combined states of more than one of the main clock signal, a polarity inversion signal that controls the polarity of the voltage of the color data, and a first clock signal and that controls a state of the second control signal in response to combined states of more than one of the main clock signal, the polarity inversion signal, and the first clock signal.

20. The source driver circuit of claim 19, wherein the output controller comprises:

a delayer for receiving the polarity inversion signal in response to the main clock signal, delaying the received polarity inversion signal for a predetermined time duration, and outputting the delayed polarity inversion signal;

a first control signal generator for receiving the polarity inversion signal in response to the first clock signal, generating the first control signal that is activated whenever the phase of the polarity inversion signal is inverted, and outputting the first clock signal as the first control signal when the phase of the polarity inversion signal does not change; and a second control signal generator for receiving the polarity inversion signal, a signal output from the delayer, and a delayed first clock signal, and generating the second control signal that is deactivated in response to a rising edge or falling edge of the polarity inversion signal, is activated in response to a rising edge of the first clock signal, and is maintained at the same level when the phase of the polarity inversion signal does not change.

21. The source driver circuit of claim 20, wherein the second control signal generator further comprises a delay clock unit for receiving the first clock signal in response to the main clock signal, delaying the first clock signal, and outputting it as the delayed first clock signal.

22. The source driver circuit of claim 19, wherein the delayer comprises a plurality of flip flops.

23. The source driver circuit of claim 19, wherein the first control signal generator comprises:

first and second flip flops for receiving, delaying and outputting the polarity inversion signal in response to the first clock signal;

a second X-OR means for receiving signals output from the first and second flip flops, and performing an X-OR operation on these signals;

a second inverter for inverting and outputting an output of the second X-OR means;

an AND means for performing an AND operation on an output of the second inverter and the first clock signal;

a third X-OR means for performing an X-OR operation on a signal that is an inverted signal of the inverted output of the first flip flop among the flip flops of the delayer, and a signal output from the third flip flop; and an OR means for performing an OR operation on outputs of the third X-OR means and the AND means, and outputting the result as the first control signal.

24. The source driver circuit of claim 19, wherein the second control signal generator comprises:

a first X-OR means for receiving the polarity inversion signal and a signal output from the delayer, and performing an X-OR operation on these signals;

an SR latch for receiving an output from the first X-OR means and the delayed first clock signal and outputting the output from the first X-OR means; and a first inverter for inverting an output of the SR latch and outputting the result as the second control signal.

* * * * *